United States Patent [19]

Mednis

[11] Patent Number: 4,573,595

[45] Date of Patent: Mar. 4, 1986

[54] MATED CONTAINER UNITS

[75] Inventor: Juris M. Mednis, Howell, N.J.

[73] Assignee: Universal Symetrics Corporation, Howell, N.J.

[21] Appl. No.: 560,597

[22] Filed: Dec. 12, 1983

[51] Int. Cl.[4] ..... B65D 21/02

[52] U.S. Cl. ..... 215/10; D9/370; D9/375; 206/509; 215/1 C; 222/143

[58] Field of Search ..... 206/504, 508, 509, 510; 220/23.4, 353; 222/143; D9/370, 373, 375, 376; 215/1 C, 10

[56] References Cited

U.S. PATENT DOCUMENTS

| | | | |
|---|---|---|---|
| D. 259,766 | 7/1981 | Hartung | D9/375 |
| D. 267,701 | 1/1983 | Pardo | D9/375 |
| D. 269,762 | 7/1983 | Grant | D9/375 |
| D. 274,699 | 7/1984 | Epperson | D9/370 |
| 2,513,894 | 7/1950 | Rogers | 220/253 |
| 3,225,951 | 12/1965 | Poston | 220/23.4 |
| 3,782,602 | 1/1974 | Page | 222/143 |
| 3,933,268 | 1/1976 | Buske | 220/23.4 |
| 3,994,408 | 11/1976 | Beltizky | 220/23.4 |
| 4,243,162 | 1/1961 | Klygis | 215/1 C |

FOREIGN PATENT DOCUMENTS

| | | | |
|---|---|---|---|
| 24165 | 2/1981 | European Pat. Off. | 220/94 A |

*Primary Examiner*—George E. Lowrance
*Attorney, Agent, or Firm*—Angelo Notaro

[57] ABSTRACT

A multi-purpose container unit whose hollow body, neck and shoulder sections are proportioned and constructed in a manner that allows interfacing and mating with an identical or mirror image unit of like size, volume or exterior proportions in mirror image. The container has a neck and a recessed portion along its vertical axis which accepts and provides safe harbor and protection to the neck and closure portion of a first container of the mated unit whose corresponding body recess, in turn, accepts its neck and closure portion of a second container of the mated unit resulting in a new composite geometrical shape such that the outside dimensions of the mated pair of containers provides improved packing economy.

23 Claims, 36 Drawing Figures

MATED CONTAINER UNITS

BACKGROUND OF THE INVENTION

This invention relates to a shaped container for packaging, storing, transporting and distributing various substances, in particular, liquid chemicals, oils and other fluids, such as beverages, cosmetics and medications, as well as other materials such as pastes, powders, tablets or granulated substances and, more particularly, to a shaped-container of the type having a main body with a recessed surface and an elongated pouring nozzle, spout or neck which when mated with another such shaped container is specifically designed to form a differing, compact, new combination structure and which achieves the principal benefits and advantages of this invention when mated with such other unit.

There are many container applications which require the use of a significant neck or spout to facilitate a directed discharge of the contents of the container. Many motor oil producers, for example, have recently adopted a plastic, cylindrical container (see U.S. Pat. No. Des. 255,544) having a funnel-shaped spout in lieu of the traditional, quart-size metal or composite canister previously used in the sale of motor oil to the automotive user market. The funnel-shaped spout provides an integral mechanism for pouring oil directly into the oil fill opening of a car without, at least in some cases, the need to use a funnel or hose or both.

Quart size, cylindrical oil cans and cylindrical containers with funnel-shaped spouts are typically packed in fiberboard cartons. Neither type of these containers lends itself to re-orientation within a carton, as a rectangularly prismatic form, to increase packing economies.

Even where an elongated neck is not essential, containers are often designed with a long neck due to aesthetic considerations or the functional versatility which is achieved.

However, containers which have a funnel-shaped spout, as well as other container designs which depart from overall configurations in the form of the basic geometric shapes of squares, rectangles and cubes, lead to a packaging inefficiency that contributes to a higher product sales price and, ultimately, waste.

Various container configurations have been disclosed which are designed to stack or interfit and thereby improve utilization of packaging space. U.S. Pat. No. 3,933,268, for example, discloses a container of prismatic form. The container has a lateral face which is stepped so that projecting and recessed face zones of two containers can be interengaged to provide better utilization of space in stacking and storage. Other types of laterally interlocking containers are disclosed in U.S. Pat. Nos. 3,994,408 and 4,165,812. The lateral interlocking of containers, however, does not resolve the packaging inefficiencies which occur where a elongated spout is provided at the top of the container.

A longitudinally-stackable, block-type container, in which the neck of one container fits into the recess of another container, is disclosed by U.S. Pat. No. 2,960,248. Basically, the block containers of this patent contain a bottom wall with a central recess having a depth designed to closely receive the neck section of a similar container. In the illustrated embodiments, the neck section is relatively short in relation to the main body of the container. Although a substantial savings in space is achieved, it is clear that the inefficiencies of the prior art designs are not resolved in relation to the space surrounding the neck of the upper units if such are stacked in a generally rectangular carton. In fact, the disadvantages of the prior art are readily evident as the length of the neck is increased. Other types of longitudinally stackable containers are disclosed by U.S. Pat. Nos. 3,369,688 and 3,391,824.

In U.S. Pat. No. 4,243,162, a container vessel is provided that has an elongated spout which can be folded for storage and transport. The plastic vessel comprises a hollow body for containing a quantity of fluid and an elongated pouring spout connected to the body via a corrugated portion which is bendable or flexes between a pouring position and a storage recess along the side of the hollow body. The bending of the spout into the recess does not necessarily maximize spatial economy and subjects the wall to material fatigue stresses which may eventually lead to a break and the release of the container's contents. In addition, the flexing feature discourages unattended emptying of container contents, for example, as may be the case in pouring motor oil into an oil fill opening of an automobile.

SUMMARY OF THE INVENTION

According to the present invention, a shaped container is provided which maximizes packaging economy even though the container has a firm, substantially elongated neck or pouring spout relative to the main fluid or other material containing body of the container. The packaging economy is achieved by interengaging or mating two shaped containers which are substantially identical, as if produced from the same mold, or mirror images of each other as may also be produced by two separate molds.

The shaped containers of the invention are designed so that two substantially identical or two mirror-image containers may be interengaged with each other. Generally, the container comprises a hollow body for containing the main volume of the contents of container which may be in fluid or solid form, or both. The hollow body includes a side wall, a bottom wall and at least one upper shoulder substantially closing at least part of the end of the body opposite the bottom wall. A hollow elongated neck is integrally connected directly to the shoulder or to side wall and to the shoulder to permit a flow of the contents of the container from the body through the neck. The side wall includes a recessed surface which extends from the shoulder in the direction opposite from the neck for a distance at least as long as the neck. The recessed surface has a shape conforming to, that is, generally matching the shape of the front of the neck. The container may be interfitted in mating relationship with an identical or substantially identical or mirror image container with one or more shoulders of each being placed in contiguous relationship with the shoulder or shoulders of the other, such that the front face of each container is on a common plane with the back surface of the other container, and the front of the neck of each is contiguous to the innermost surface of the recess of the other.

A container, according to one preferred embodiment of the invention, comprises a generally rectangular body topped by a sloped planar shoulder and an elongated, tapered neck which, at its base, is connected to the rear of the shoulder and to the side wall. The neck has a circular cross-section with a rearwardly-facing planar back side or back side slide which is, preferably, vertically flush with the rear wall of the body. A recess, extending from a point in the shoulder, is formed in the side wall of the body opposite the side wall to which the neck is connected and has a tapered circular shape designed to closely receive the neck of a substantially identical container.

Two containers constructed in accordance with the invention may be interfitted in a reverse interlocked configuration with the neck of each received in the recess of the other such that an essentially continuous outer surface is formed, preferably in a polyhedral shape such as a cube or rectangular prism in order to maximize the use of packaging space within a carton in which a multiple number of the containers are packed.

Containers constructed in accordance with the invention increase the packing capacity of any appropriately dimensioned rectangular prismatic space, by allowing the doubling, within a packing carton of whatever number of container units that are designed to occupy or efficiently relate to the use of the bottom plane of such carton or the base of the defined rectangularly prismatic space.

The various features of novelty which characterize the invention are pointed out with particularity in the claims annexed to and forming a part of this specification. For a better understanding of the invention its operating advantages and the specific objects attained by its use, reference should be had to the accompanying drawings and descriptive matter in which there are illustrated preferred embodiments of the invention.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION

With regard to the broad precepts of the invention, recess means are provided within the body of a first container for receiving the neck of a second container which has the identical form and/or is a mirror image of the first container.

Figure 1:
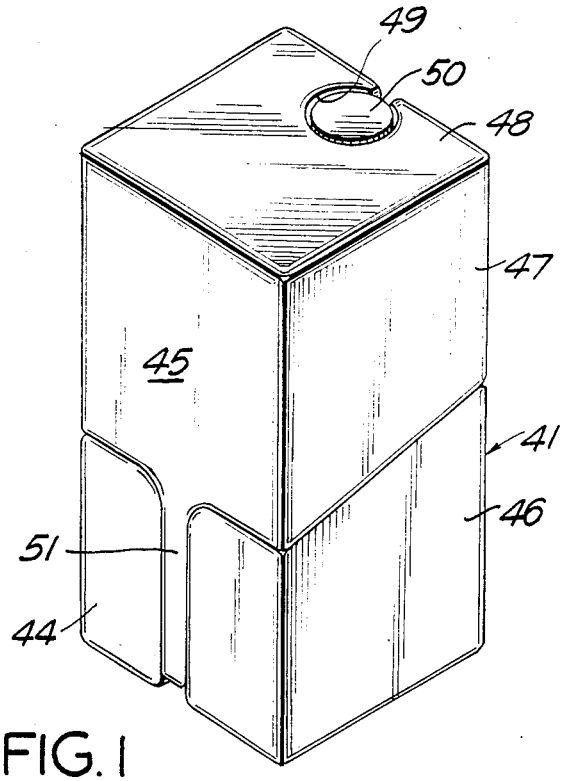
FIG. 1 is a perspective view of a mated pair of identical containers of a form made in accordance with a first embodiment of the invention.

In the embodiment of the invention illustrated in FIG. 1, an arrangement is shown in which two identical containers 40 are vertically mated with a lower container positioned upright and an upper container positioned with its up side extending downwardly. Each container 40 includes a body 41 which is designed to contain the main volume of the contents of the container and an elongated neck 42.

The body 41 includes an upper shoulder 43 and a polygonal front wall 44, rear wall 45, side walls 46, 47 and a bottom wall 48. A recessed surface 49, open at the shoulder, extends from the shoulder 43 through the length of the body 41 and is also open-ended at the bottom wall 48. At least part of the recessed surface 49 is circular and conforms to the shape of the neck 42 as described hereafter.

The neck 42 is integrally formed as part of the container. The base of the neck is integral to the shoulder 43 and the rear wall 45 of the body. The neck 42 is a hollow, open-ended tube which allows the ready through passage of the contents of the body. The end of the neck opposite the body is closed with a cap closure 50 which sealably engages the neck, for example, by engaging threads (not shown) formed adjacent to the free end of the neck. Other closure arrangements, known in the art, such as snap-on connections or foil seals can be used alone, or in combination, to close the open end of the neck.

Figure 3:
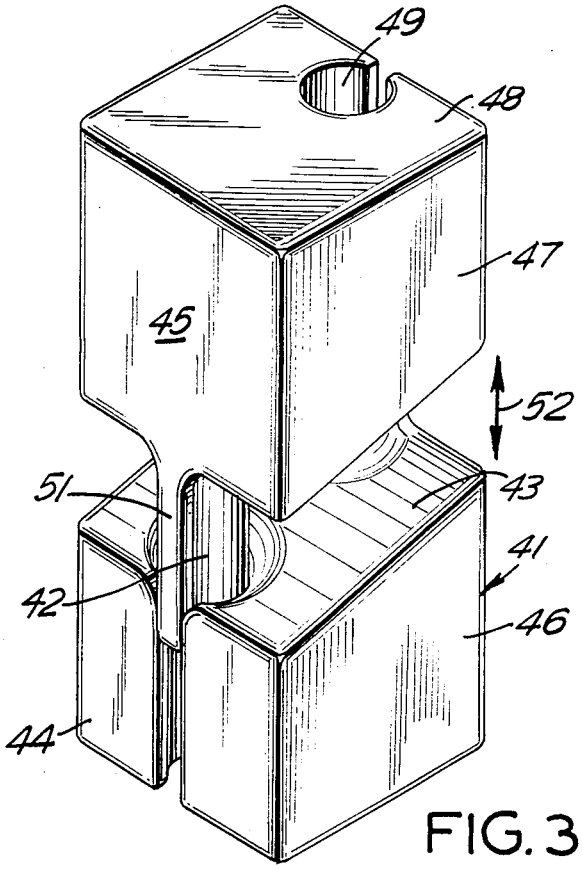
FIG. 3 is a perspective view, partly exploded, of the containers of FIG. 1.
Figure 4:
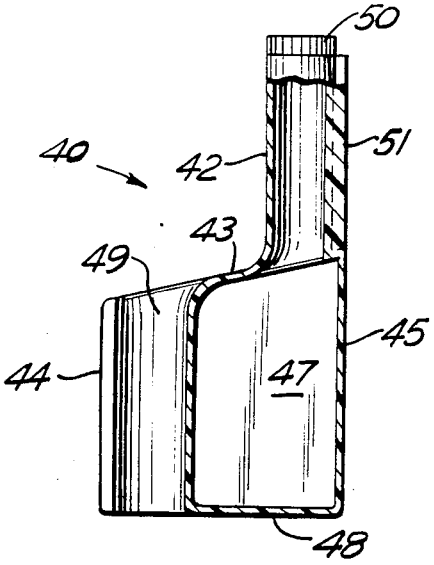
FIG. 4 is a sectional view taken along the view lines 4—4 of FIG. 1.
Figure 5:
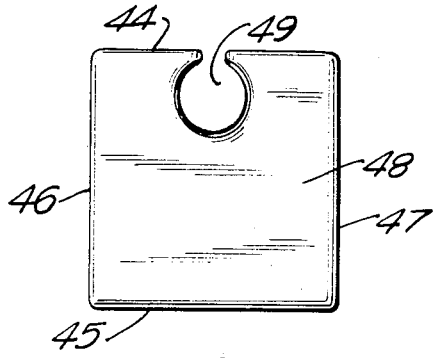
FIG. 5 is a bottom plan view of the container of FIG. 2.

The neck 42 has a circular face portion which is designed to be closely and contiguously received against the recessed surface 49 of an identical container 40. A slide rib 51, as best shown in FIGS. 3 and 4, is provided along the length of neck 42 at the rear side of the body 41. In the illustrated embodiment, the recessed surface 49 is open at the outer face of the body by a slotted interruption within the front wall 44 of the body 41. The rib 51 engages the slotted interruption formed when two identical containers 40 are mated.

Figure 2:
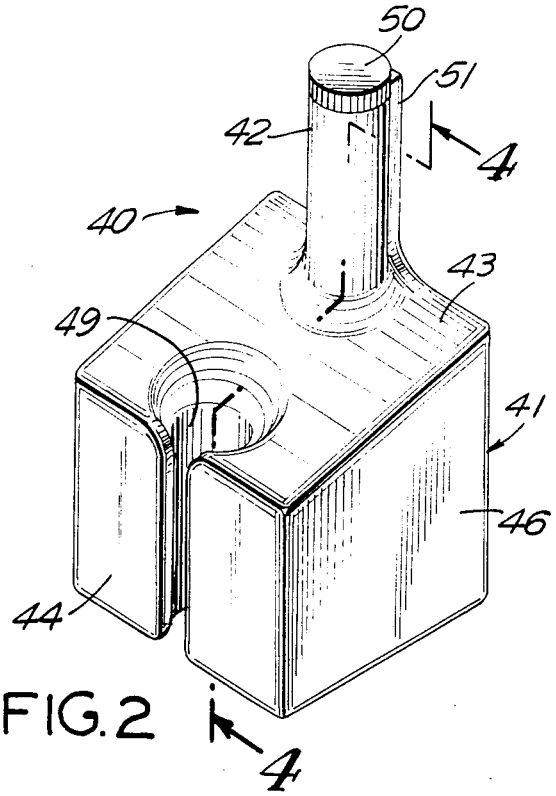
FIG. 2 is a front perspective view of one of containers of FIG. 1.

In the embodiment of FIGS. 1–4, the shoulder 43 is formed at the end of the body opposite the bottom wall 48 and slopes upwardly from the front wall 44 to the rear wall 45. The recessed surface 49 is formed centrally at the front wall and the neck 42 is formed centrally at the rear of the container. Thus, the front wall 44 comprises two planar surface portions joined by the recessed surface 49 which, as shown in FIG. 2, includes semi-circular shape.

When two containers 40 are mated, as shown in FIG. 1, the rear wall 45 of the upper container is vertically flush along a common plane with the front wall 44 of the bottom container. The opposite side walls of the respective containes are also flush, the shoulders abut and the bottom walls are parallel.

The two containers are matingly engaged by orienting the neck of each container to extend in directions opposite each other and toward the bottom wall of the other. For example, as shown in FIG. 3, the lower container is oriented in an upright position and the upper container is oriented up-side-down. The neck of each container is inserted into the recess of the other at the opening in the shoulder, and the containers are moved toward each other parallel to the arrow 52 so that the rib 51 slides along the slotted interruption of the opposite container to form a mated unit as shown in FIG. 1. While preferable, the rib 51 could be omitted and the slotted interruption could be widened to a width at least slightly larger than the neck to allow the containers to be brought together face to face, i.e., in a lateral direction perpendicular to arrow 52.

Figure 6:
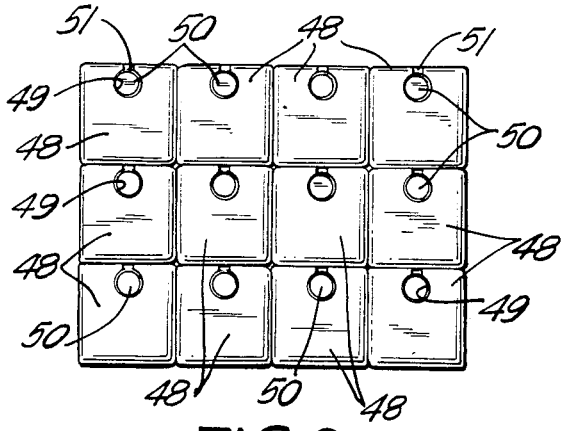
FIG. 6 is a top view of twenty-four of the containers of the first embodiment mated in pairs and arranged in a rectangular 4×3 array.
Figure 7:
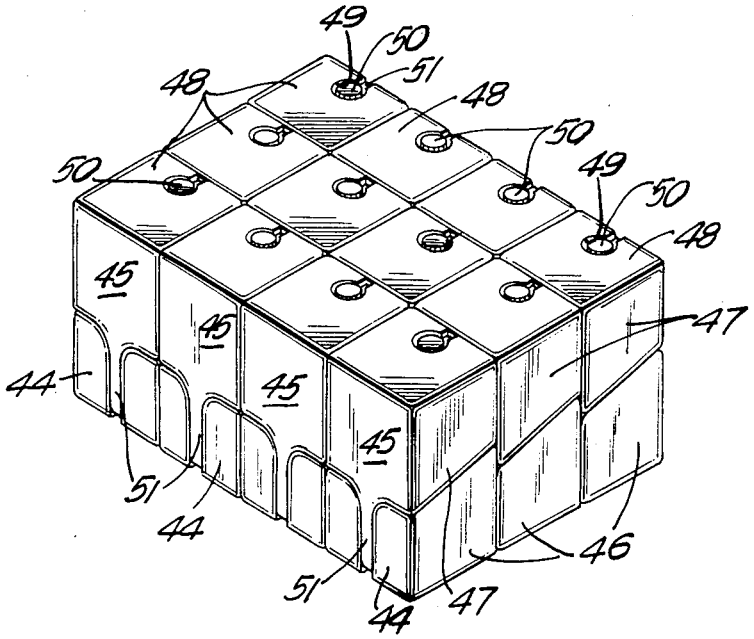
FIG. 7 is a perspective view of the twenty-four mated containers of FIG. 6 stacked as they might be placed in a packing and shipping carton.

FIG. 6 illustrates, in a plan view, the arrangement of twenty four containers 40 mated in a 4×3 rectangular array. A perspective view is shown by FIG. 7. It will be evident to those skilled in the art that this provides maximum utilization of the space within a rectangular packing carton of similar size.

Figure 8:
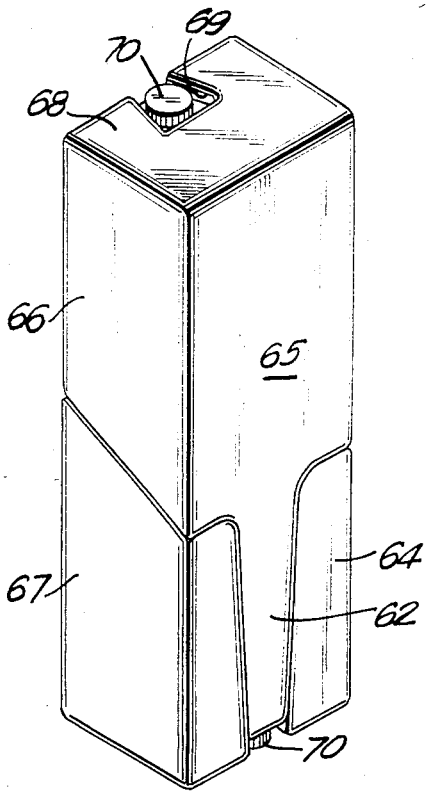
FIG. 8 is a perspective view of a mated pair of identical containers having a form made in accordance with a second embodiment of the invention.
Figure 10:
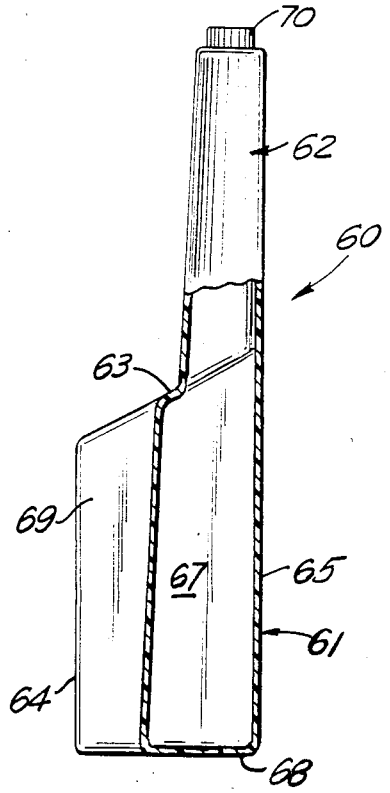
FIG. 10 is a side cross-section of the container of FIG. 9.

FIG. 8 illustrates a mated pair of identical containers 60 constructed in accordance with a second embodiment of the invention.

Figure 9:
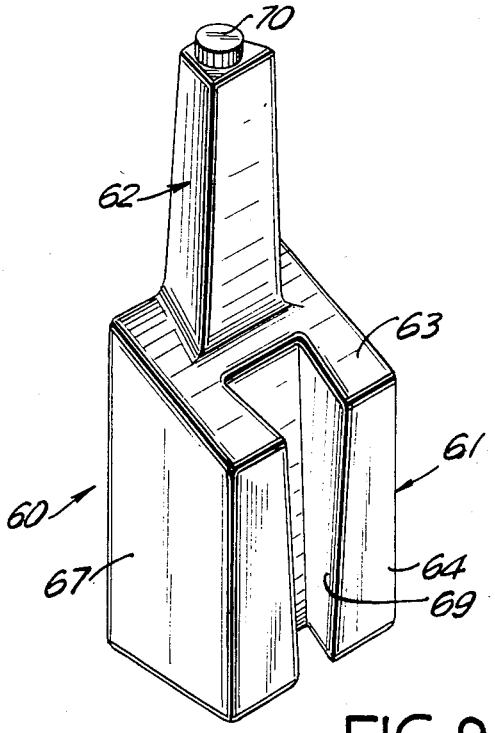
FIG. 9 is a front perspective view of one of the containers of FIG. 8.
Figure 11:
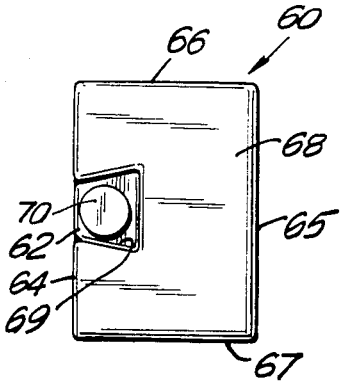
FIG. 11 is a bottom view of the mated combination of FIG. 8.
Figure 12:
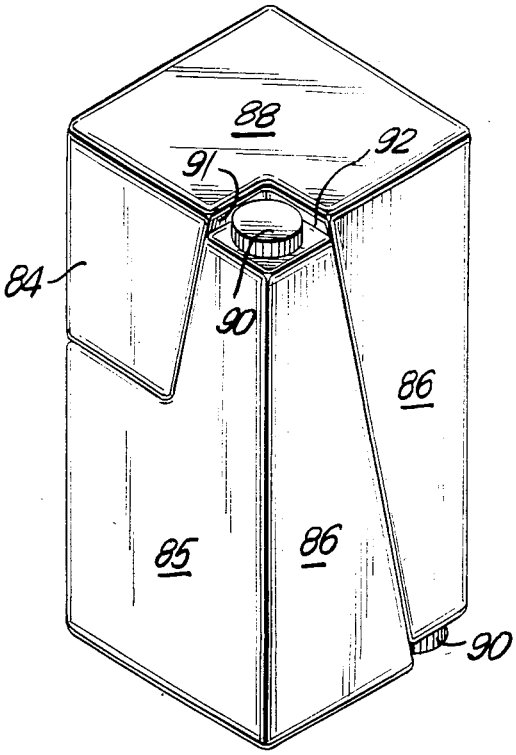
FIG. 12 is a perspective view of two mated containers of identical form formed in accordance with a third embodiment of the invention.
Figure 13:
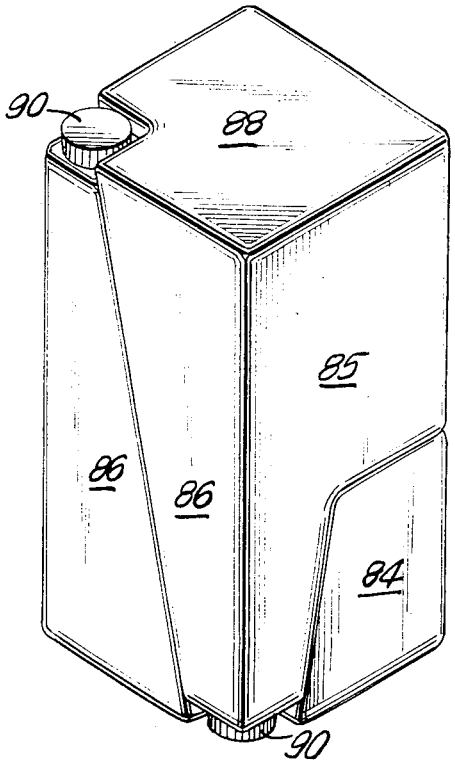
FIG. 13 is a perspective view of the embodiment of FIG. 12 as viewed from the opposite side.
Figure 14:
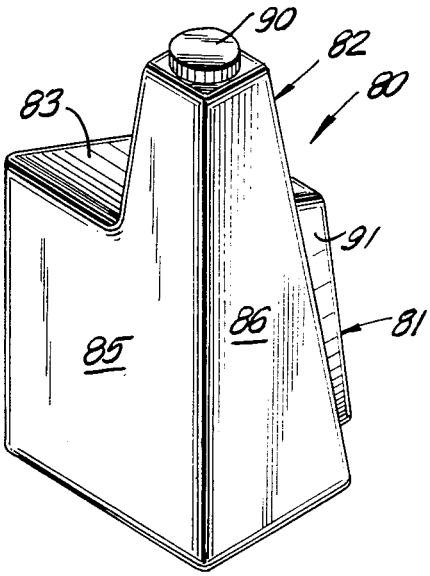
FIGS. 14 and 15, respectively, are left and right perspective views, of one of the containers of FIG. 12.
Figure 15:
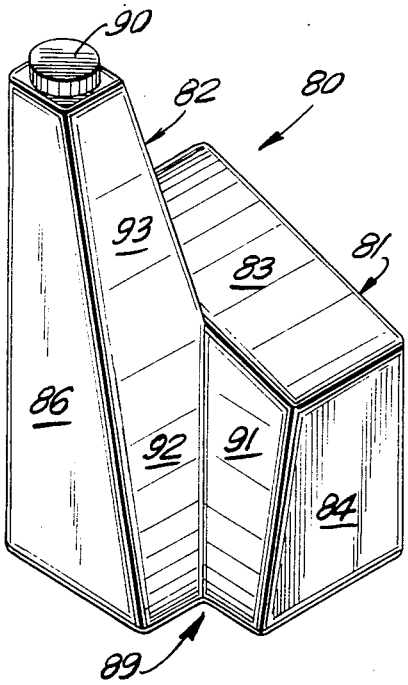
Figure 16:
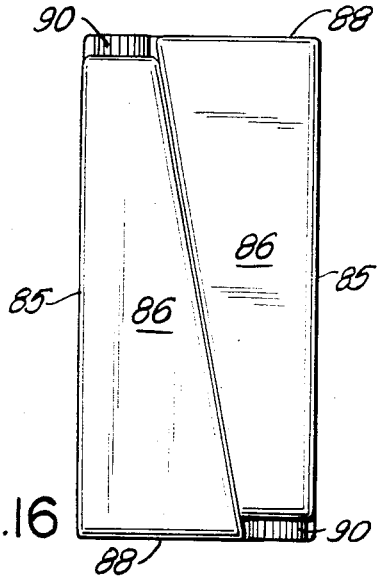
FIGS. 16, 17, 18 and 19 are side elevation views of the combination of FIG. 12.
Figure 17:
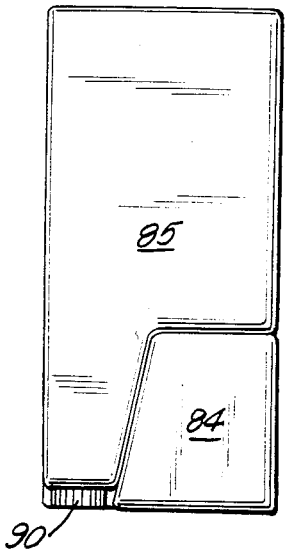
Figure 18:
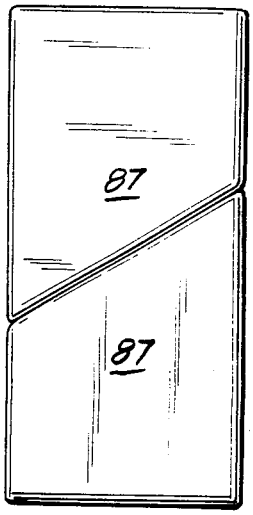
Figure 19:
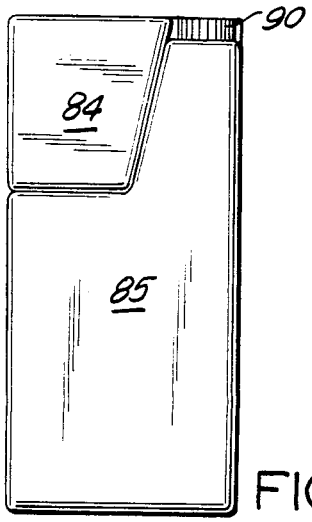
Figure 20:
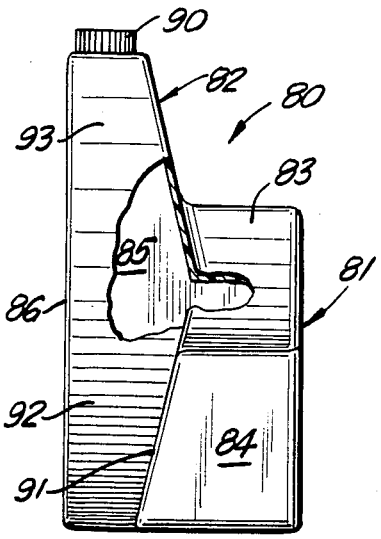
FIGS. 20 and 21 are right side views, partly in section, of the container of FIG. 14.
Figure 21:
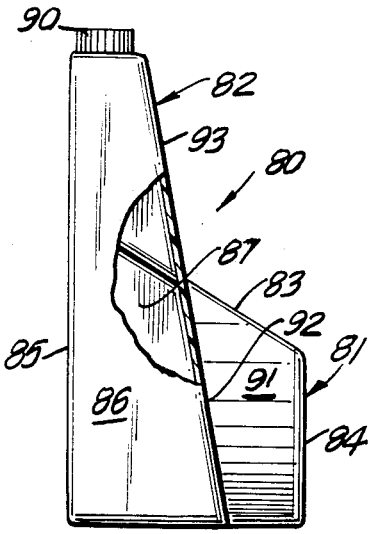
Figure 22:
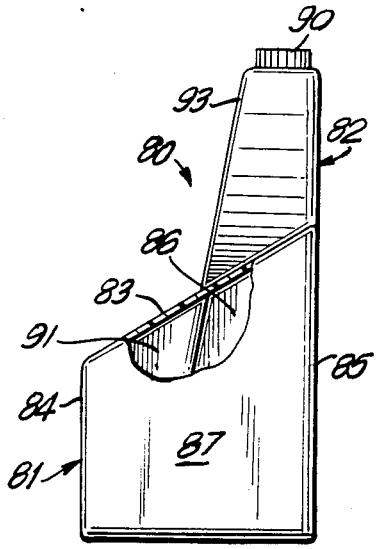
FIG. 22 is a left side view, partly in section, of the container of FIG. 14.

As shown in FIG. 9, the container 60 is composed of a vertically elongated body 61 and a vertically elongated neck 62.

The body 61 includes an upper sloped shoulder 63, and a side composed of a generally rectangular front wall 64, rear wall 65 and side walls 66, 67 and, as well, a bottom wall 68. A longitudinal recessed surface 69 is centrally provided in the front wall 64 and extends along the length of the body 61 from the bottom wall 68 to the shoulder 63. The recessed surface 69 is shaped to conform to the front of the neck 62, as described hereafter and, accordingly, in the embodiment of FIG. 9 has a circular shape. The recessed surface 69 must have sufficient length to accommodate the entire length of the neck 62.

It is essential that the recessed surface 69 extend from the shoulder 63, but the recessed surface 69 does not have to extend for the entire length of the body so long as it extends for a distance of sufficient length to accommodate the full length of the neck 62.

The shoulder 63 is planar with an upper surface and slants upwardly from the front wall 64 to the rear wall 65 of the container. In an alternative embodiments, not shown, the shoulder may slope downwardly from the front wall to the rear wall or have a wave form with a symmetrical arcuate peak and recess on opposite sides of a centerline disposed between the front and rear walls of the body.

The elongated neck 62 has a prismatic configuration with a trapezoidal cross-section. Particular spatial economy is realized where the neck has a length comparable to the length of the body. Thus, in preferred embodiments of the invention, the neck 62 has a length substantially equal to the length of the bŏdy. The neck 62 is centrally located at the rear of the container such that the planar surface of the neck is vertically aligned and flush with the rear wall 65 and the rear side of the shoulder section 63. A conventional closure 70 is utilized to close the open, upper end of the neck 72.

As best shown in FIG. 8, two identical containers 10 may be matingly engaged by sliding the neck of each into the recess of the other. The mated pair of the containers presents a compact interfitted combination. The containers are first arranged in a lateral front facing relationship on opposite sides of a plane and then one or both are rotated parallel to the plane so that each extends in a direction opposite to the other. The containers are then lognitudinally spaced, laterally moved to longitudinal superjacent positions and then brought together as shown in FIG. 8. The front surface of the neck 62, of each, abuts the innermost part of the recessed surface 69 of the other and the side surfaces of the neck abut the side surface portions of the recessed surface; the planar upper surfaces of each shoulder 63 are also juxtaposed against each other. Thus, the longitudinal recessed surface 69 of the lower container 60 receives the entire neck 62 and closure 70 of the upper container 60 which is oriented in a reverse direction while the recessed surface 69, within the body of the upper container 60, similarly receives the neck 62 and closure 70 of the lower container 60. Since the neck has a trapezoidal cross-section, with the wider base line being the width of the front surface of the neck, when mated, the containers are laterally locked, i.e., they cannot be separated by any movement in a direction normal to the lengthwise axis of the container but can only be pulled apart by a movement parallel to that axis.

In a variation of the second embodiment of FIGS. 8–11, the elongated neck could be formed with a circular configuration, that is, with the front facing portion of the neck being circular for 180-degrees and with the rear surface planar. In such case, the recessed surface would be formed with a complementary circular surface, open at the front wall to a width at least slightly larger than the diameter of the circular portion of the neck. Thus, two properly oriented containers of such a variant embodiment could be mated or separated by a simple, lateral movement in respect to their lengthwise axes.

An arrangement of polyhedral containers 80, formed in accordance with a further embodiment of the invention, is shown in FIGS. 12 through 20. In this embodiment, the neck and recessed surface are not centrally located. Each container 80 includes a stepped body 81 and an integral neck 82 extending from a portion of the body 81 to the side of a shoulder 83.

The container 81 is formed with a generally rectangular bottom wall 88. A rectangular corner recess is provided along a corner of the body intermediate the faces of a front wall 84 and a side wall 86 which do not extend along a single plane for the full width of the respective front wall 84 and side wall 86 thereby defining a recessed surface 89 which includes a first planar surface 91 and a second sloped planar surface 92. The second planar surface 92 connects with a third planar surface 93 to define the front face of the neck 82.

The neck 82 extends from the body along the side wall 86 of the container adjacent to the recessed surface 89 and also adjacent to the rear wall 85. The shoulder 83 closes the portion of the body which is not topped by the neck and extends to the side wall 87, opposite the side wall 86 topped by the neck. The neck has four polygonal planar surfaces. As noted above, the one polygonal planar wall surface 93 connects with the second planar surface 92 of the recessed surface 89. Both preferably are in the same plane. Two other wall surfaces of the neck are on the same plane as, and appear as parts of, the side wall 86 and the rear wall 85 of the body. The fourth side wall is connected to the shoulder 83 intermediate the first-mentioned planar wall surface and rear planar wall surface of the neck 82.

A closure, such as threaded cap 90, closes the open end of the neck in a conventional manner.

Two containers 90 are mated by turning one up-side-down relative to the other and by bringing them together such that the planar surface 93 of neck of the upper container abuts against the planar surface 92 of the body of the lower container. The respective shoulders 83 of each are contiguous. Each outer surface of the combination is essentially continuous.

Figure 23:
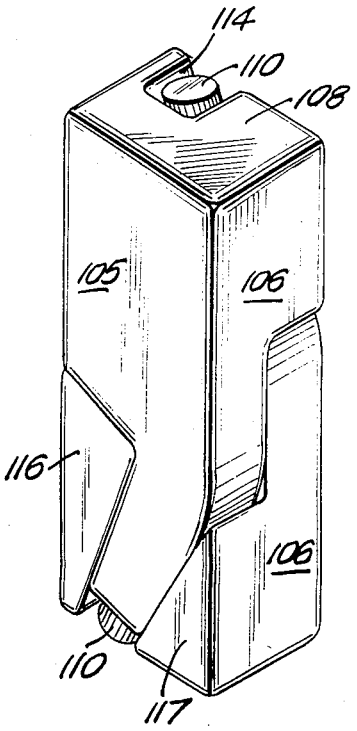
FIG. 23 is a perspective view of a mated pair of identical containers having a form according to a fourth embodiment of the invention.
Figure 24:
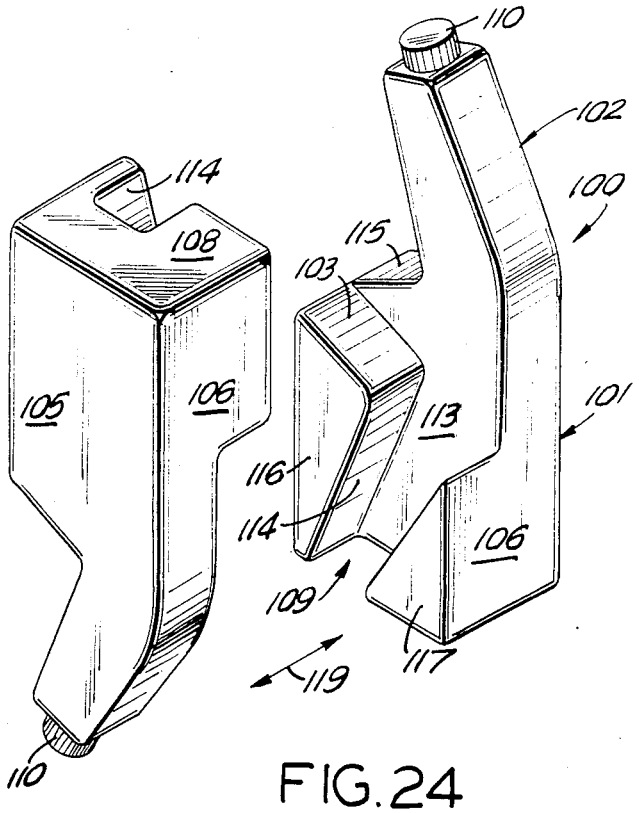
FIG. 24 is an exploded version of the combination of FIG. 23.

FIGS. 23 and 24 illustrate identical containers 100, according to still a further embodiment of the invention, in which a curved neck 102 is angled upwardly from a shoulder 115, away from the vertical centerline of the container. The body 101 includes a slanted or curved recess extending from a shoulder 103 and angled relative to the vertical centerline in a direction opposite to the curvature of the neck, symmetrically about a common horizontal axis therebetween, and adapted to receive and accommodate the neck 102 of an identical container.

Taking the body 101 as that part of the container 100 other than the neck 102, the body may be considered to be composed of a substantially rectangular rear portion and two substantially triangular front portions laterally spaced to form opposite sides of the recess and thereby defining a recessed surface 109 comprising a front surface 113 of the rear part of the body, a side surface 114 of one of the triangular parts and the opposite facing surface (not shown) of the other one of the triangular parts.

The body 101 includes the two shoulders 103 and 115, a front wall comprising the two front faces 116, 117 of the triangular parts, a first side wall 106 and a second opposite side wall (not shown), a rear wall 105 and a bottom wall 108.

The neck 102 is integrally formed as part of the body intermediate the shoulder 115 and side wall 106, adjacent to the side wall 106 and part of the rear wall 105. The neck curves upwardly toward the side of the container opposite side wall 106. The neck has an open end which is normally closed with a closure 110.

Two containers 100 may be combined into a mated container combination by orienting both in an upright position with the front wall of each facing the other, rotating the containers 180-degrees relative to each other and then moving one or both containers together, as shown by arrow 119 to form the combination as shown in FIG. 23 so that the front surfaces 116, 117 of one are flush with the rear surface 105 of the other.

Figure 25:
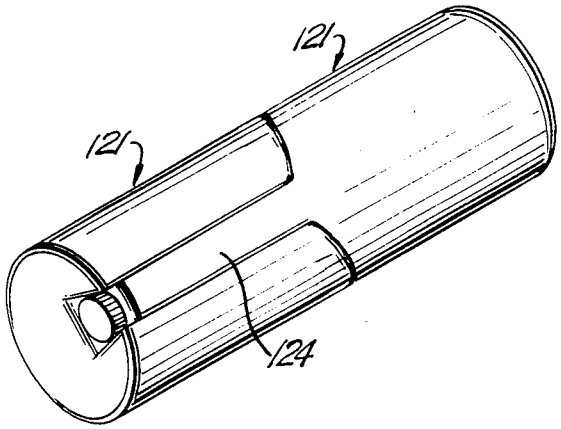
FIG. 25 is a perspective view of a mated pair of identical containers made in accordance with a fifth embodiment of the invention.
Figure 26:
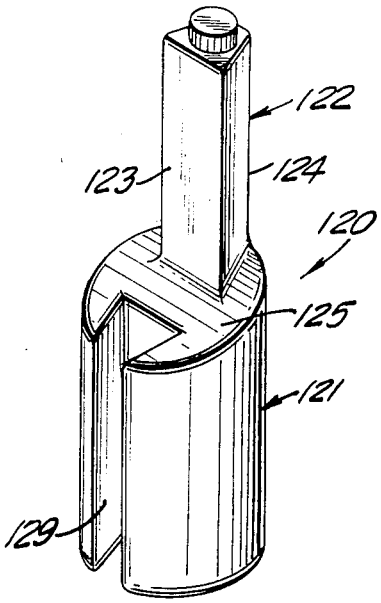
FIG. 26 is a perspective view of one of the containers of FIG. 25.

FIGS. 25 and 26 illustrate even still a further embodiment in which identical containers 120 including a cylindrical body portion 121 and an elongated neck 122. The front face of the body is centrally provided with an elongated slot to define a recessed surface 129 which is open at the surface of the body. The neck has a rectangular front face 123 and a rearward circular face 124. Two containers 120 may be slidably engaged by longitudinally inserting the neck of one into the recess of the body of the other until the shoulders 125 of each abut. As best seen in FIG. 26, the width of the recess expands as the depth of the recess increases. Hence, the recess is larger at its inner base within the body. Thus, when two containers are longitudinally engaged, they will be laterally interlocked.

Although the preceding embodiments have been described in terms of identical containers, i.e., containers which would be produced from the same mold or identical molds, the principles and packaging advantages of the invention are equally applicable to containers which are the mirror-image along the front face which will be contiguous when the containers are mated.

Figure 27:
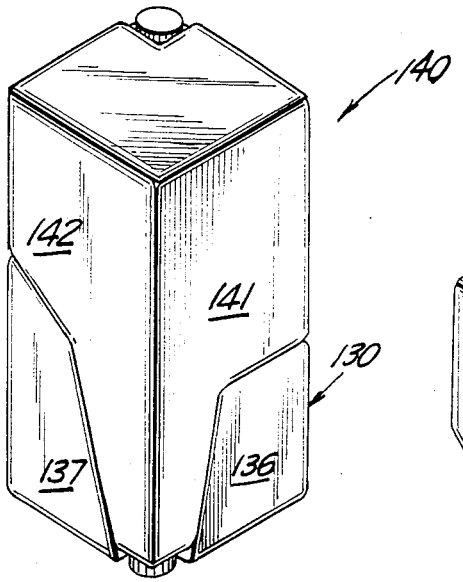
FIG. 27 is a perspective view of a mated pair of mirror-image containers made in accordance with a sixth embodiment of the invention.
Figure 28:
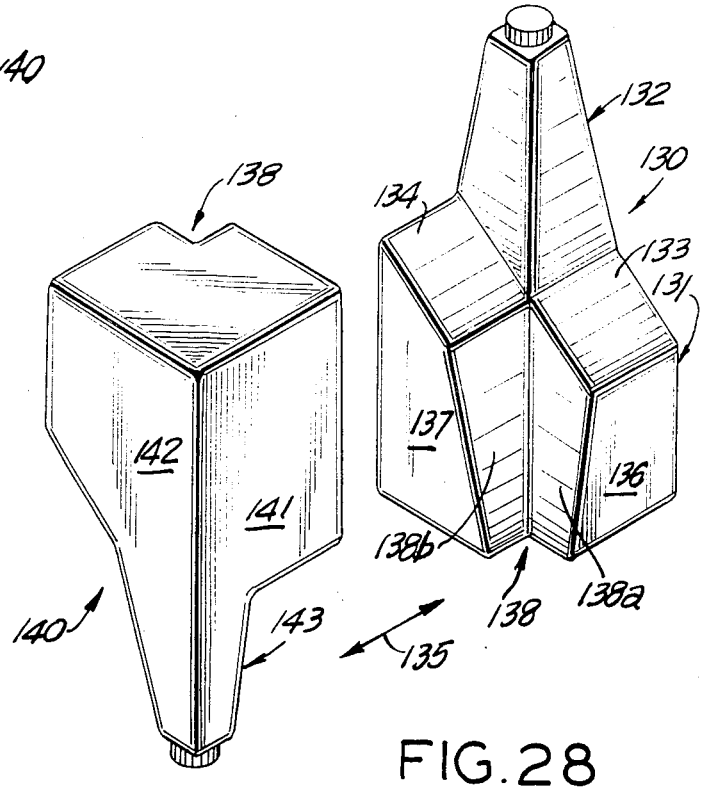
FIG. 28 is an exploded perspective view of the containers of FIG. 27.
Figure 29:
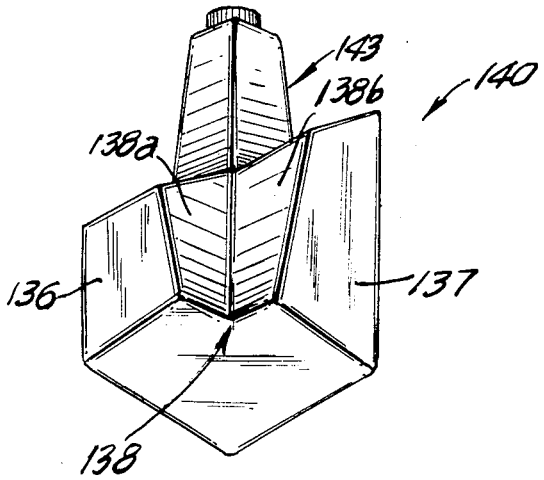
FIG. 29 is a perspective view of the uppermost container of FIG. 27.
Figure 30:
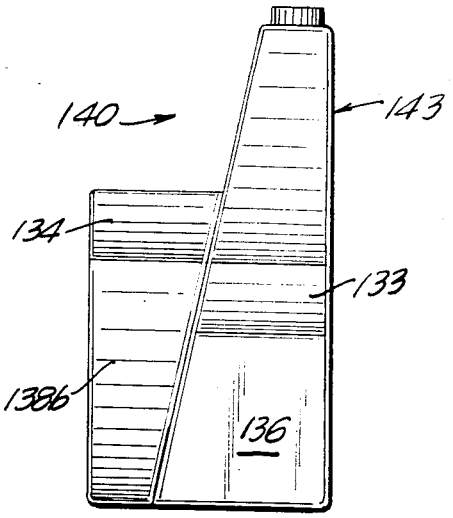
FIG. 30 is a left-side view of the container of FIG. 29.
Figure 31:
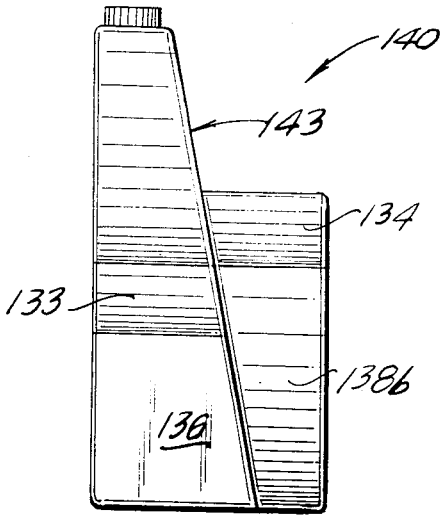
FIG. 31 is a right side view of the container of FIG. 29.
Figure 32:
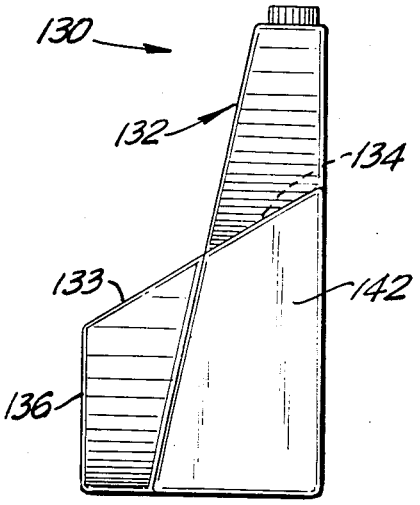
FIG. 32 is a left side view of the lower container of FIG. 27.
Figure 33:
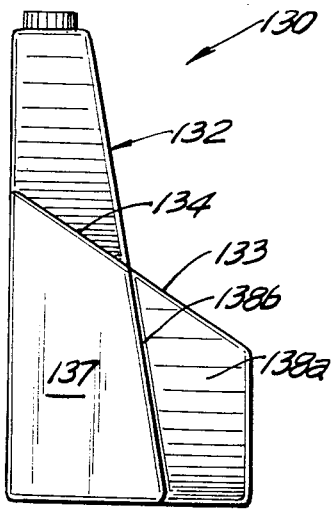
FIG. 33 is a right side view of the lower container of FIG. 27.

An embodiment of mirror-image containers is illustrated in FIGS. 27 and 28. As shown in FIG. 28, a container 130 includes a prismatic body 131 having a corner recessed surface 138. An elongated and tapered rectangular neck 132 is integrally connected to the body; the neck 132 tapers upwardly as it extends from the body 131 from a corner of the body opposite the recessed surface. The body is topped by shoulders 133, 134 on each of the sides of the neck 132 which are not flush with the outer wall surfaces of the body. Two sides of the neck 132 are flush with a respective side wall and a rear wall of the body. The opposite two sides of the neck extend upwardly from the shoulders and are slanted.

The recessed surface 138 comprises two slanted polygonal surfaces **138*a* and 138*b* which extend downwardly from the shoulders. Surface 138*a* is a side wall of a forwardly extending body portion which projects from the left front side of the body and surface 138*b*** is a fore wall of a laterally extending body portion which projects to the right side of the body.

A second container 140 is provided in which the various wall portions of the body and neck are mirror images of the front face of the body and neck of the container 130. Thus, the body of container 140 includes a body portion which forwardly projects from the right side of the body and a laterally extending portion which laterally projects to the left side of the body. The two containers 130, 140 are mated as shown in FIG. 27 by orienting each in a reverse direction and then laterally bringing them together with the respective necks 132, 143 fitted into the respective recess of the other by a relative movement as illustrated, for example, by the double arrow 135. Thus, the rear wall 141 of container 140 and the foremost front wall 136 of container 130 are flush within a common plane. Similarly, the respective side walls 142, 137, as well as the opposite side walls and rear walls (not shown in FIG. 27) are flush. The bottom walls of each container of the mated pair are essentially parallel.

Figure 34A:
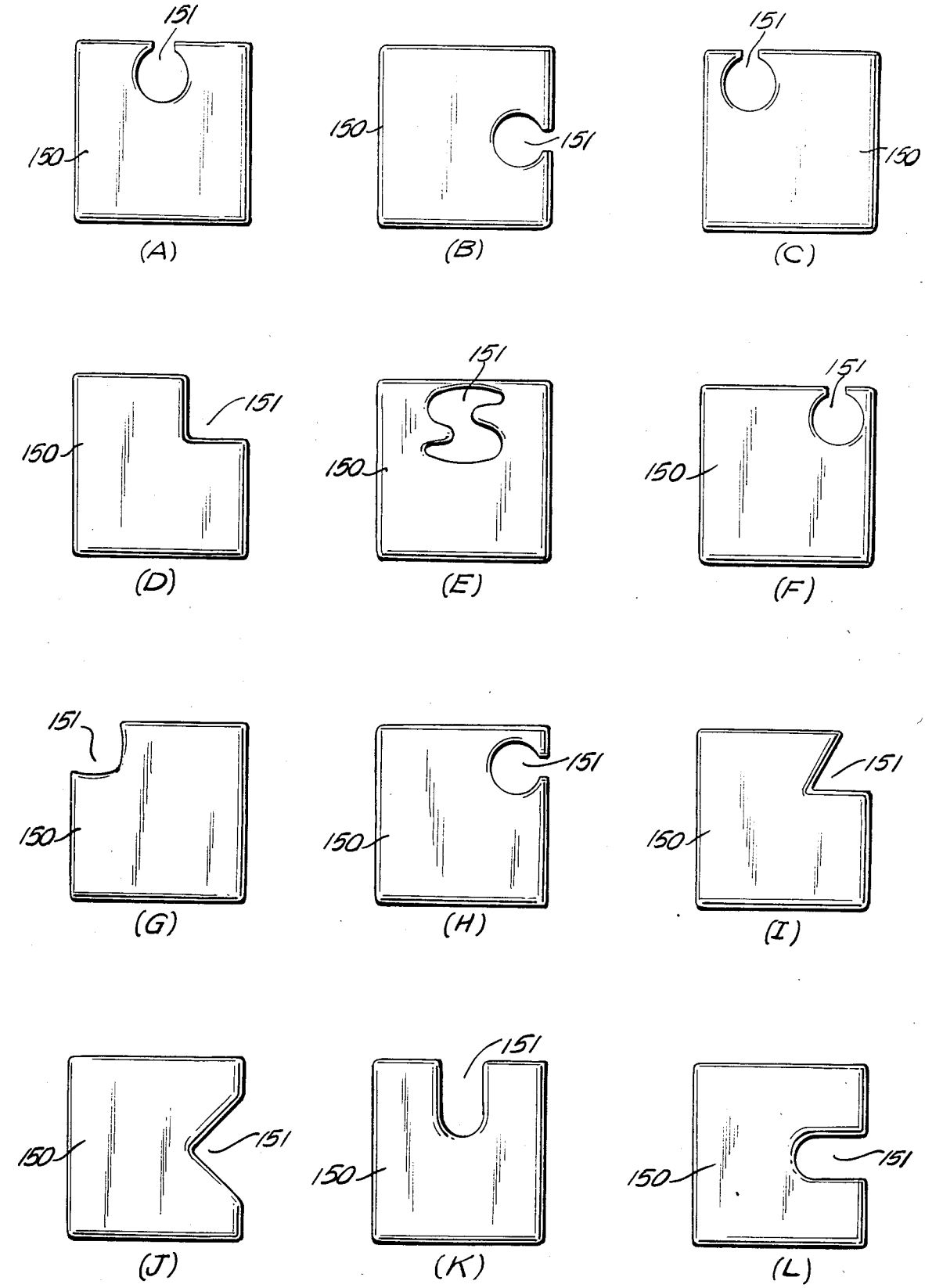
FIGS. 34A to 34C illustrates various base configurations of containers or container combinations made in accordance with the invention.
Figure 34B:
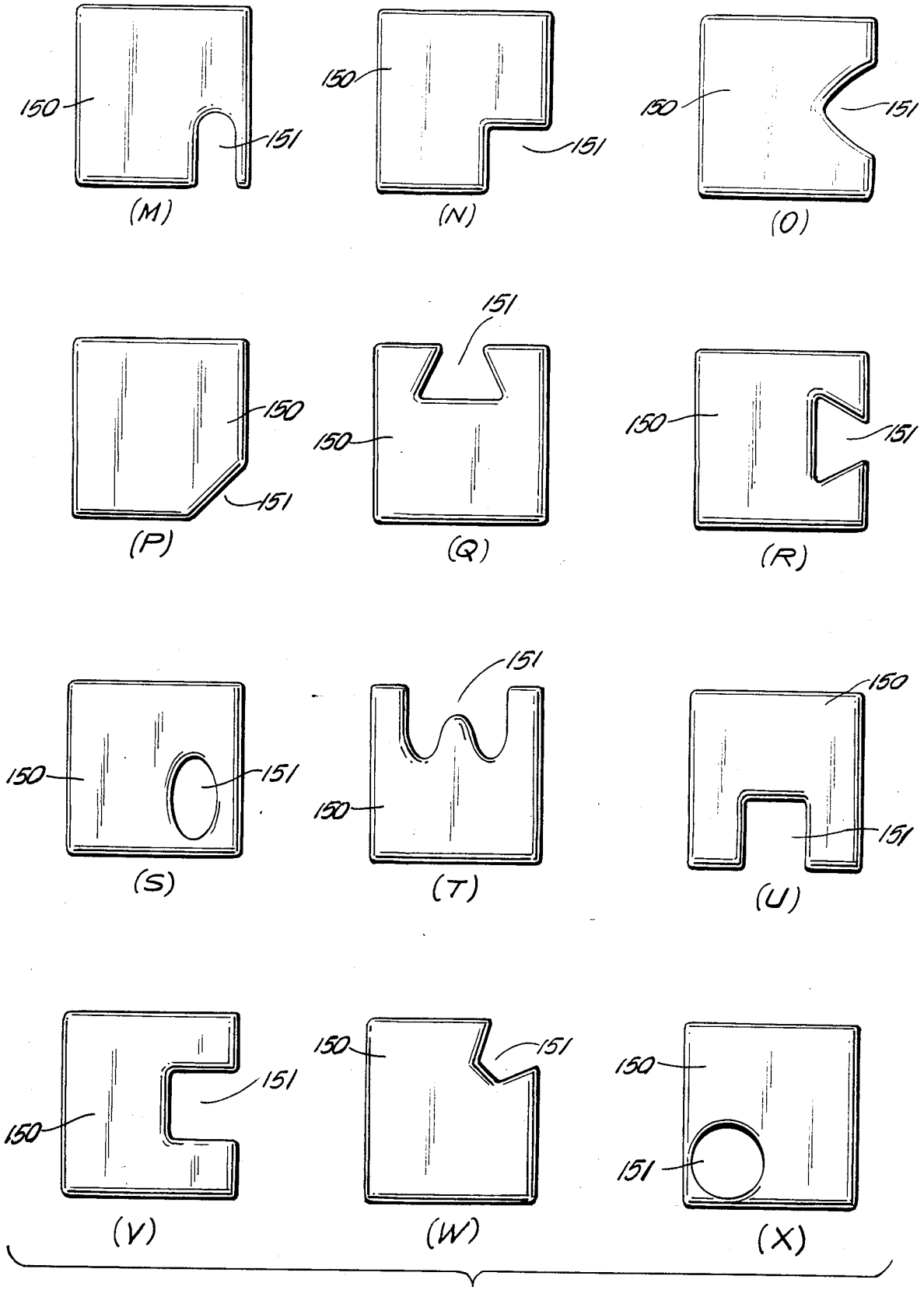
Figure 34C:
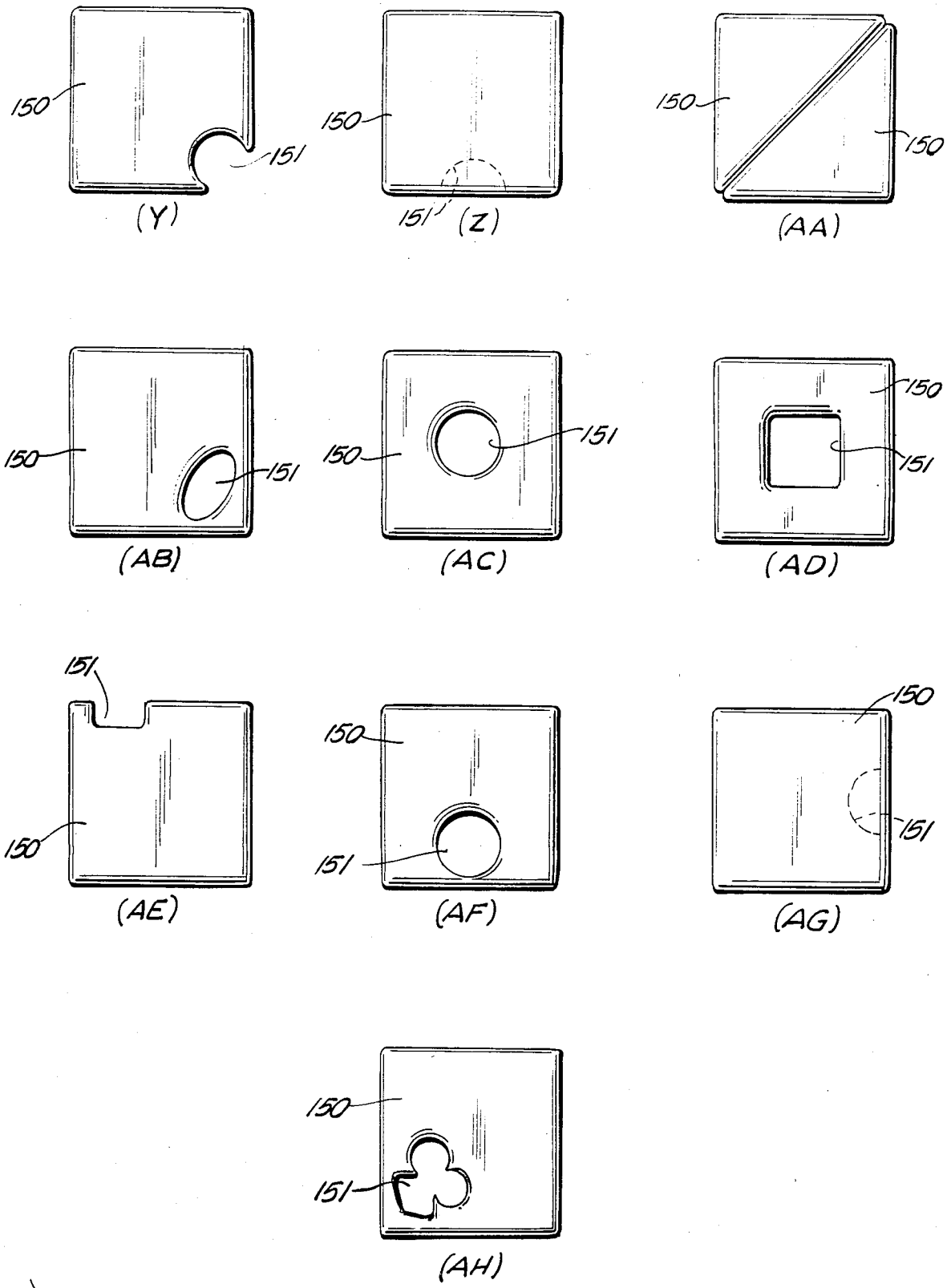

The shape of the neck and the complementary recessed surface may take various forms such as are illustrated by the various representations of a bottom wall 150 and recesses 151 in FIGS. 34A through 34C.

It should be understood that the recessed surface does not necessarily have to be open at the bottom wall in the various embodiments but could be closed so that the closure can be protected from damage or tampering. Several of the bottoms, such as shown in FIG. 34C(Z) and FIG. 34C(AG) are closed so as to illustrate that the recess does not have to necessarily extend down to the bottom wall. Since the closure is protected within the recess of the recessed surface, whether or not the recessed surface is open at the bottom wall, greater opportunities are present for the use of unthreaded open ends of necks which are closed by inexpensive closures such as foil seals which adhesively adhere to the periphery of the opening formed within the neck. Recesses spaced from the side walls are also shown in FIGS. 34A–34C to illustrate that the recesses do not have to be necessarily be open along a surface of the body but could accommodate a neck which curves to the center.

Provision of an elongated neck ensures ability to pour the contents of the container into difficult to reach openings without the aid of a funnel. Accessibility to even more remote points is increased by use of a sloped shoulder configuration which increases reach. Generally, the open end of the neck of the container can be inserted into more apertures into which the contents may be poured, such as the oil fill compartment of an automotive engine. When pouring the contents of the container into an oil fill aperture of an engine, after insertion, the container can be left standing in the pour position until empty without a need to manually support the container, thereby, leaving hands free for other activity.

Those skilled in the art of container design will appreciate that the containers of the inventive design have an identifiable neck and shoulder, the neck being the narrowest portion of the container and the shoulder being that portion of the container which tops at least a portion of the body connects or borders the neck. The planar shoulder may be perpendicular to the front or back of the container or disposed at an angle to produce a sloping surface starting at or near the base of a container or at any higher point and thereafter joining the neck. The specific slope of the shoulder is not material to the invention and the slope may extend upwardly from the front wall of the container to the neck or may extend from any point on the front wall of a container and progress downwardly toward the back of the container.

The placement or location of the recessed surface designed to receive and protect the neck and closure of another container, when mated, is placed at any desired part of the container. It may be centered on the front wall, offset to one side or at an exterior corner of the container. The depth of the recessed surface depends upon the distance of the front face of the neck from the rear wall. Preferably, the rear surface of the neck of a first container will be flush with the front wall of a second container when the units are mated thereby providing a continuous outer surface. The recessed surface extends parallel to, or generally in the direction of the vertical axis, or parallel to the longest straight edge. The neck may also be directed upwardly from the shoulder at any preferred angle not necessarily parallel to the vertical axis as shown in FIG. 24. In such case, the recess of the body may be placed in mirror image configuration positioned to receive the neck of a mated unit. The generally elongated recessed surface may include further recesses laterally disposed relative to the longitudinal axis of the recessed surface, for example, to accommodate a bulbous or enlarged lips surrounding the neck.

The end of the neck and its closure may be flush with exterior dimensions of the bottom wall of its mated container or it may be recessed below the plane formed by that container's bottom wall. The neck may be cylindrical through the major portion of its length, cylindrically tapered, resemble a funnel or may have other geometrical configurations. Its cross-sectional shape can differ at various points along its length. The cross-sections of the body and neck of the container may take various geometric forms which allow the formation of a recessed surface along the side of the body.

The side walls and ends of a container, and the resulting paired and mated container unit, can be provided with one or more elevations, recesses, grooves or ridges to accomplish interlocking between two or more paired containers and thereby increase packing, stacking and transport stability. The neck of the container may have one or several cross-sections of different shapes. The recessed surface or female portion of a container, within which the neck and closure of a mated unit are to be fitted, preferably has the same or similar shape in its cross-section as the neck.

In addition, the recessed surface of a container may allow either the lateral insertion of another container's neck within the recess of the recessed surface or, in other embodiments of the invention, require a longitudinal sliding movement of one or both containers toward each other to complete mating.

The elongated neck and the shape of container, constructed according to the various embodiments of the invention, with its recessed surface, provides ease, control, and convenience in holding, handling, carrying and use in dispensing contents, with a minimal opportunity for waste of contents by spillage and, also, eliminates the need for an accessory funnel in at least some operations in which the contents of the container are removed therefrom. The mating of two containers, constructed according to the invention, takes place along a number of different planes to provide substantial convenience in use of the mated-container combination which can be fitted together in multiples in stacks or boxes held together by tape, strapping bands or light weight wrapping such as shrunk-on film or plastic sleeves.

The shoulders may extend in one or more horizontal, vertical or diagonal planes. The shoulder of each container may have an elevation or be formed, measured from the base to top of the shoulder, at varying heights to provide a slope to the top of the shoulder which may or may not be generally parallel to the bottom wall.

The closure may be molded and closed after filling or may consist of other conventional or specially designed devices to increase protection of the contents or reduce the cost of the closure.

An interlock may be provided by minor variations in neck design and in the design of the shoulder. For example, by increasing the front elevation of the shoulder relative to the rear elevation of the embodiment of FIG. 9, the neck configuration produces an interlock design, which when coupled with the interlock formed by the fitting of the neck within the recess of any similarity dimensioned unit. An interfaced combination unit is formed with contacting surfaces on several planes held in place by the joined interface of structural design elements, by adhesion or by tension between the mated containers being enhanced by the tensions and pressure exerted by the contents of the container.

Mated containers, according to the invention, are stacked for transport and configured to reduce and neutralize the de-stabilizing lateral forces inherent in and produced by movement.

Two mated containers or any multiples of such mated containers for packing, storing and transport purposes may be stacked and joined with other such units within boxes and cartons, covered and held together within frames or similar devices, within and by shrink-film, and by other wrapping materials, tapes, bands or strings.

The mated pairs of containers can be readily made to be tamper resistant, e.g., by placing a tear seal across the edges of mated faces on the outer walls of the combination and recessing or shielding the closure within the recess. A tear element could be similarly provided within the recess so as to give a positive indication of tampering upon separation of one of the mated containers from the other.

A container, as shown in FIG. 2, can be ready constructed to contain a capacity in excess of about one U.S. quart. The mated pair of containers shown in FIG. 1 can hold somewhat more than two U.S. quarts.

Exemplary exterior dimensions of the two mated units as shown in FIG. 1 follow:

| | |
|---|---|
| Length of edge | 10 cm |
| Length of edge | 20.5 cm |
| Length of edge | 9 cm |
| Length of edge | 11.5 cm |
| Width of top of recess | 4.5 cm |
| Width of base of neck | 4.4 cm |
| Width of top of closure | 3 cm |
| Width of neck just below thread portion | 3.5 cm |
| Length of paired unit | 20.5 cm |
| Angle of shoulder | 15° (approx) |
| Length of neck | 9.3 cm |
| Back length of neck to Top of closure | 8.4 cm |

None of such dimensions or the specific angles are limitations of this invention. The containers may be produced in conformance with U.S. volume measurements as well as denominated in volume measurements of the metric system. Significant conversion to the use of this type of container by the petroleum oil industry, for example, will help actual economic adoption of metric standards within the packaging industry. Containers of various basic shapes may be reinforced or modified to increase structural rigidity or body and neck integrity by providing lips around selected edges, by increasing the density of material in portions of each container such as the neck, for example, by the addition of bars, lines, designs or other structural reinforcing elements which by themselves are not germane to this invention. The mated paired units illustrated in FIG. 1, containing two U.S. quarts and materials and accompanying "air space" allowing for variations in fill process occupy about 2,122.4 cubic centimeters (10.2 cm×10.2 cm×20.4 cm), or 1,061.2 cubic centimeters per quart.

A standard cylindrical U.S. quart container made of metal or composite paperboard, as in which automotive oils are packaged, requires storage space of about 1456.6 cubic centimeters (10.2 cm×10.2 cm×14 cm).

A typical quart size funnel-shaped spout type motor oil container, having the design disclosed in U.S. Pat. No. Des. 255,544 requires storage space of about 1924.7 cubic centimeters (10.2 cm×10.2 cm×18.5 cm).

Thus, it can be seen that standard cylindrical cans require about 395.4 additional cubic centimeters of storage space and the funnel-shaped spout type container require 863.5 cubic centimeters more than the mated container of FIG. 1 for a one quart volume. This respectively represents 37% and 81% larger storage and transport space requirements. Packed in mated units as illustrated in FIG. 1, 27.2% less space is needed per U.S. quart compared to the standard cylindrical cans and 44.9% less space than required by the funnel-shaped top type container as used in the automotive oil industry.

The container, according to the invention, can be readily manufactured using existing plastics technology, processing and manufacturing techniques. The container can also be formed from other materials such as foils or glass. The container is preferably molded or shaped from a thermoplastic such as polyethylene, polyethylene terethalate, polyprophylene, polyvinyl chloride, or the like and produced by process such as injection blow molding, extrusion blow molding, stretch blow molding, extrusion stretch blow molding, or monolayer or multi-layer techniques.

In another structural form of the container according to the invention, the oval or round cylindrical shape of the container provides protection of the necks and closures within the paired mated units but affords less packing, storage and transport stability and efficiencies than units with rectangular or triangular bases.

In still another constructional variant of the invention, where the units are made of soft, flexible or pliable materials such as foils, non-rigid plastics, paper or cardboard or a combination or such or similar materials an individual unit may lack substantial rigidity and may in handling and packing resemble a bag with an elongated neck such neck being of similar materials as the body or additionally reinforced. And in even still another constructional variant of this invention, the female recessed surface or neck receptacle formed within an individual unit may be partially or wholly enclosed producing increased protection from possible unauthorized tampering.

Containers and specifically mated pairs whether containing the packaged product or after its dispensation, whether filled with air or filled with other materials, for example, sand or water, can be readily stacked in various combinations and used as building blocks, toys and a variety of other applications.

Individually serving as highly functional containers, paired and mated container units and multiples thereof allow highly efficient handling, transport, storage and display. During or after service as containers, units individually mated or in multiples of pairs can serve as design, play, construction or structural elements or modules with a broad range of uses and applications.

Although the specification and claims refer to relative positioning such as "front" and "rear" for clarity, it will be understood that the scope of the invention is not limited by these terms of relative orientation where the positioning can be redefined, for example, by opposite terms without departing from the spirit of the invention.

As a specific example, the neck in several of the described bodies is stated to be positioned at the "rear" wall and the recessed surface in the "front" wall. It should be understood that the positioning could be reversed in many of the described embodiments while still allowing the containers to be combined into an equivalent mated combination.

I claim:

1. The combination comprising a pair of mated containers wherein (a) each container comprises a hollow body for containing the contents of the container including a polygonal front wall, polygonal rear wall, polygonal lateral side walls, a polygonal bottom wall and an upper shoulder forming at least a substantial portion of the top of the body opposite the bottom wall, a hollow elongated neck integrally connected to the body to permit a flow of the contents of the container from the body through and out of the end of the neck, the body including no more than a single recessed surface for receiving the neck of the other container of the pair of mated containers, said recessed surface extending from the shoulder for a distance at least as long as the neck and having a shape conforming to the shape of the neck, the recessed surface comprising an elongated opening interrupting the surface of the front wall; (b) the neck of each one of the mated containers being disposed within the recess of the recessed surface of the other one of the mated containers, with the end of each neck adjacent to the bottom wall of the other container, and the shoulder of each container being placed in contiguous relationship with the shoulder of the other container; (c) the neck having a length substantially equal to the length of the body as defined by the distance between the bottom wall and the shoulder; (d) the mated containers forming a polyhedron substantially filling and occupying no more than the minimum rectangular polyhedral volume needed to encompass, the neck and body of a single one of the containers; (e) further comprising means for preventing lateral separation of the mated containers in a direction lateral to the axis of the neck; and (f) the neck including a surface conforming to the shape of the recessed surface and the neck further including a rear surface which, when containers are mated extends in alignment with the uninterrupted surface of the front wall of the other container.

2. The combination as set forth in claim 1 wherein two identical containers are interfitted in mating relationship.

3. The combination as set forth in claim 2 wherein, when mated, a lateral side wall of one container is flush with a lateral side wall of the other and the front wall of each container is flush with the rear wall of the other container.

4. The combination as set forth in claim 1 wherein two mirror-image containers are interfitted in mating relationship.

5. The combination as set forth in claim 4 wherein, when mated, the side wall of each container is flush with the side wall of the other.

6. The combination as set forth in claim 1 wherein the shoulder is planar.

7. The combination as set forth in claim 1 wherein the neck includes a semi-circular surface and a planar rear surface vertically aligned with the rear wall.

8. The combination as set forth in claim 1 wherein the recessed surface extends from the shoulder along an axis substantially parallel to the neck.

9. The combination as set forth in claim 1 wherein the recessed surface extends from the shoulder through the bottom wall.

10. The combination as set forth in claim 1 wherein the neck has a trapezoidal cross-sectional shape.

11. The combination as set forth in claim 10 wherein, when mated, the wider portion of the neck is contiugous to the innermost portion of the surface of the recessed surface and wherein the recessed surface extends about the neck so as to comprise means for preventing lateral separation of the mated containers in a direction lateral to the axis of the neck.

12. The combination as set forth in claim 6 wherein the front wall includes an opening extending along the length of the body, at the center of the front wall, from the shoulder to the bottom wall and in communication with the recess of the recessed surface for its full length.

13. The combination as set forth in claim 1 wherein the recessed surface is formed along a corner of the body intermediate the front wall and one of the lateral side walls.

14. The combination as set forth in claim 13 wherein said polygonal rear wall including a first planar wall surface of the neck, and wherein one of the lateral side walls includes a second planar wall surface of the neck; a third planar wall surface of the neck being on the same plane as a first part of the corner and wherein the neck includes a fourth wall surface connected to the shoulder intermediate the first and third planar wall surfaces.

15. The combination as set forth in claim 6 wherein the shoulder extends at a slope from the front wall to the rear wall.

16. The combination as set forth in claim 1 wherein the shoulder comprises a first shoulder and a second shoulder, the front wall having two substantially triangular front portions laterally spaced at opposite sides of the recessed surface, wherein said recessed surface extends angularly from the first shoulder relative to a vertical centerline of the container, said first shoulder being adjacent a portion of the front wall of the container and a first one of the lateral side walls, said second shoulder being adjacent a portion of the rear wall and said first one of the lateral side walls, and wherein the neck extends angularly relative to the vertical centerline in a direction opposite the recessed surface and symmetrically thereto relative to a common axis therebetween.

17. The combination as set forth in claim 4 wherein each of the mirror-image containers comprises a recessed surface formed in a first corner of the body intermediate the front wall and one of the lateral side walls; said recessed surface of one container being formed at the right side of the front wall of said container; and said recessed surface of the other container being formed at the left side of the front wall of said container; and the neck being formed at a corner of the container opposite said first-mentioned corner.

18. The combination as set forth in claim 1 wherein the front wall comprises two planar surfaces joined by the recessed surface intermediate the two planar surfaces and wherein the recessed surface is formed centrally of the front wall.

19. The combination as set forth in claim 1 wherein the shoulder is not parallel to the bottom wall.

20. The combination as set forth in claim 19 wherein the shoulder comprises two planar surfaces not parallel to the bottom wall, said two planar surfaces each being spaced at different distances from the bottom wall.

21. The combination as set forth in claim 1 wherein the recessed surface is formed centrally of the front wall and the neck is formed centrally of the rear of the container, said neck and recessed surface being disposed directly opposite each other.

22. The combination as set forth in claim 1 wherein the bottom wall comprises a closed end to recess of the recessed surface.

23. The combination as set forth in claim 1 wherein each container comprises a rigid plastic material.

* * * * *